United States Patent [19]

Thalmann et al.

[11] 4,091,861

[45] May 30, 1978

[54] APPARATUS FOR EXCHANGING POURING TUBES AT CASTING VESSELS OF CONTINUOUS CASTING INSTALLATIONS

[75] Inventors: Armin Thalmann, Uster; Josef Zeller, Weesen, both of Switzerland

[73] Assignee: Concast AG, Zurich, Switzerland

[21] Appl. No.: 773,472

[22] Filed: Mar. 2, 1977

[30] Foreign Application Priority Data

Mar. 9, 1976 Switzerland ..... 2892/76

[51] Int. Cl.[2] ..... B22D 41/08

[52] U.S. Cl. ..... 164/437; 222/606; 222/607

[58] Field of Search ..... 164/82, 281, 337, 437; 222/591, 598, 600, 601, 602, 606, 607

[56] References Cited

U.S. PATENT DOCUMENTS

| | | | |
|---|---|---|---|
| 3,743,007 | 7/1973 | Simons et al. | 222/600 X |
| 3,765,572 | 10/1973 | Neumann et al. | 222/600 |
| 3,884,400 | 5/1975 | Tuschak et al. | 222/607 |

*Primary Examiner*—Robert B. Reeves
*Assistant Examiner*—David A. Scherbel
*Attorney, Agent, or Firm*—Werner W. Kleeman

[57] ABSTRACT

An apparatus for exchanging pouring tubes at a casting vessel having a closeable bottom pour opening of a continuous casting installation. Each pouring tube has an infeed end and an outfeed end for the molten metal, typically steel, flowing therethrough and into a throughflow vessel, such as a continuous casting mold or tundish. Guides serve to move each pouring tube from an approximately horizontal introduction or infeed position into a substantially vertical casting position. The guides are structured such that different paths of movement are provided for the infeed end and outfeed end of the pouring tube, and specifically, the infeed end of the pouring tube moves along an approximately horizontal path of movement and the outfeed end of the pouring tube moves along an approximately vertical path of movement, at least a portion of which vertical path of movement is located within the throughflow vessel.

11 Claims, 4 Drawing Figures

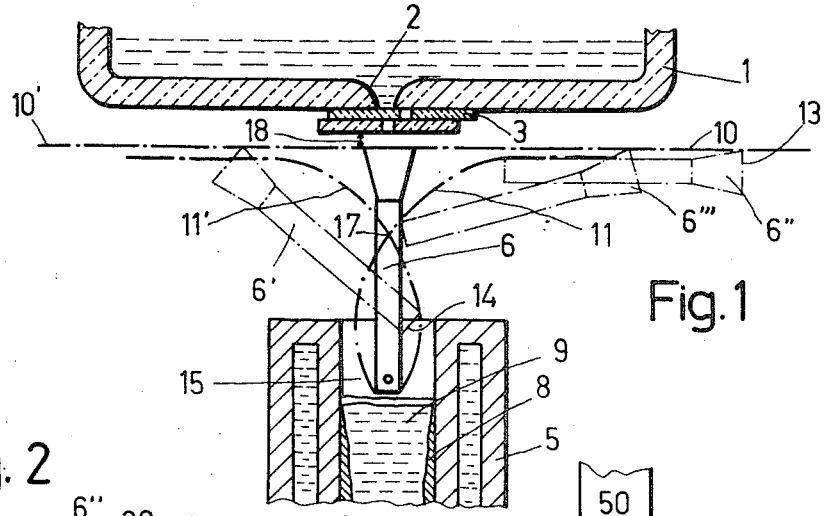
Fig. 1
Fig. 2
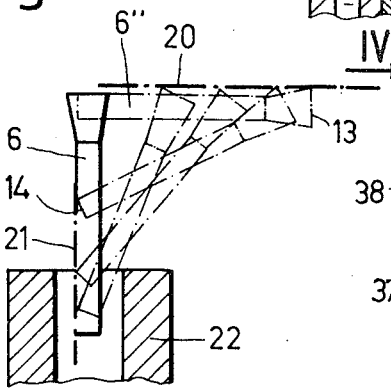
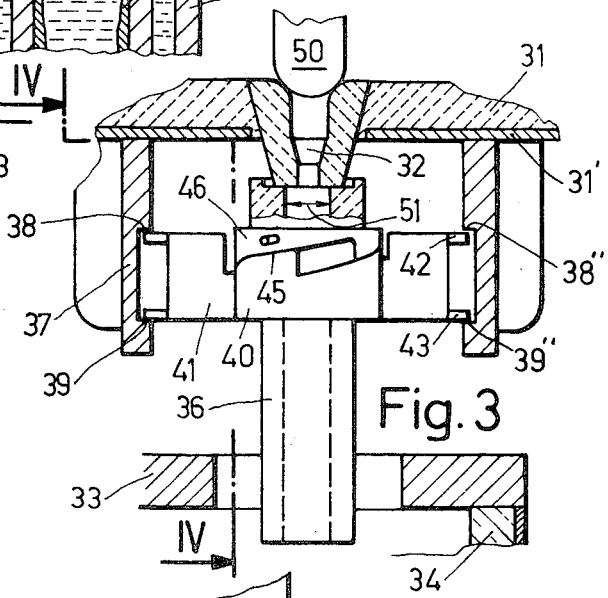
Fig. 3
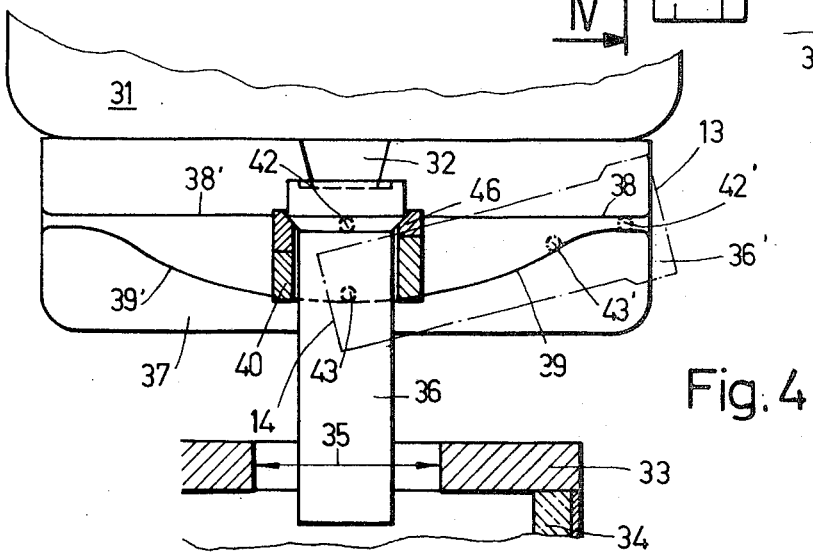
Fig. 4

APPARATUS FOR EXCHANGING POURING TUBES AT CASTING VESSELS OF CONTINUOUS CASTING INSTALLATIONS

BACKGROUND OF THE INVENTION

The present invention relates to a new and improved construction of apparatus for exchanging pouring tubes at a casting vessel of the type having a closeable bottom pour discharge nozzle or opening during the continuous casting of metals, especially steel, wherein a vertical pouring tube which protrudes into an open-ended vessel is equipped with guide means which provide for such pouring tube a path of movement out of an approximately horizontal infeed or introduction position into a substantially vertical casting position.

During the continuous casting of metals tubular-shaped protective devices are used both between the casting ladle and the tundish as well as also between the tundish and the continuous casting mold in order to protect the casting or teeming jet against oxidation. Such tubular-shaped protective devices enclose the teeming jet either over its entire length or over a part of its length and will be referred to hereinafter as pouring tubes. Such pouring tubes which are fabricated of refractory material are exposed to wear, especially when used for pours lasting over longer periods of time. Therefore, especially in the case of continuous casting installations for steel strands there exists the need to structure such pouring tubes so as to be exchangeable during the casting operation. The removal of such pouring tubes out of their casting position and the re-introduction of the same or other pouring tubes back into the casting position can also be desired, for instance, for carrying out flame work, typically for instance flame-descaling or flame-chipping operations, by means of an oxygen lance at the bottom pour opening or discharge nozzle of the casting vessel.

An apparatus for exchanging pouring tubes at a casting vessel in the form of a tundish of a continuous casting installation has become known to the art, wherein a pouring tube which extends below the level of the metal bath of an open-ended vessel in the form of a continuous casting mold cooperates with a closeable bottom pour opening. This pouring tube can be pivoted along a path between an infeed station and the casting station. During such pivoting the lengthwise axis of the pouring tube remains in its horizontal infeed position. By carrying out a further pivoting movement about a pivot axle connected with the guide the pouring tube can be brought at the casting station above the mold out of its horizontal position into a vertical casting position and thereafter is concentrically attached to the bottom pour opening of the tundish. The contemplated pivoting about the pivot axle or shaft requires a certain amount of free space within the mold in accordance with the pivot arc or circle of the outfeed end of the pouring tube. With slab widths of 1.2 meters and more sufficient space is available, as a general rule, within the mold for carrying out the aforementioned pivotal movement. In the case of smaller slab-, bloom- or billet- cross-sections the infeed or introduction cross-section or area for receiving the pouring tube is small and, therefore, such pouring tube must be rocked into the vertical position above the mold and thereafter immersed into the hollow mold compartment and the molten metal bath contained therein. The raising and lowering of the pouring tube is especially disadvantageous when working with tundishes equipped with a number of bottom pour outlets or discharge nozzles, as such are used in multi-strand casting installations. When raising the tundish for the purpose of exchanging a pouring tube the continuous casting operation is disturbed at all of the strands supplied with steel from the tundish. This disturbance is especially disadvantageous for metallurgical reasons when casting with flux powder.

Further, there is known to the art an apparatus which uses a pouring tube for protecting a casting or teeming jet between a casting vessel in the form of a ladle and a throughflow vessel in the form of a tundish. This pouring tube is elevationally adjustable by means of a lever mechanism mounted at the tundish, in order to thereby provide a tight or sealed connection with the ladle. This prior art equipment is not designed for the removal of a pouring tube from the tundish and for exchanging pouring tubes.

SUMMARY OF THE INVENTION

Hence, with the foregoing in mind it is a primary object of the present invention to provide an improved apparatus for exchanging pouring tubes at casting vessels of continuous casting installations in a manner not associated with the aforementioned drawbacks and limitations of the prior art proposals.

Another and more specific object of the present invention aims at the provision of a pouring tube-change apparatus which renders possible the introduction and removal of pouring tubes into small infeed cross-sections or areas of throughflow vessels, such as typically a continuous casting mold, without having to raise and lower the casting vessel, such as typically the tundish, during the introduction of the pouring tube.

Yet a further important object of the present invention aims at a new and improved construction of apparatus for exchanging pouring tubes at casting vessels of continuous casting installations in an extremely quick, reliable and accurate manner, which apparatus is relatively simple in construction and design, relatively economical to manufacture, not readily prone to malfunction or breakdown, and requires a minimum of maintenance and servicing.

Now in order to implement these and still further objects of the invention, which will become more readily apparent as the description proceeds, the pouring tube-change apparatus of the present development is manifested by the features that the guide means comprise guides which are arranged to form different paths of movement for the infeed end and outfeed end of each pouring tube, and that an approximately horizontal path of movement is provided for the infeed end of the pouring tube and an approximately vertical path of movement, located at least partially within the throughflow vessel, is provided for the outfeed end of the pouring tube.

With such construction of apparatus it is possible to exchange pouring tubes at casting vessels filled with a molten metal during the casting operation without the need to lift the casting vessel, and importantly, even when working with small infeed cross-sections or areas of the throughflow vessels, typically the continuous casting mold, or to temporarily shift the pouring tube out of the way when flame work on other operations have to be carried out at the bottom pour discharge nozzle or opening. In this regard, it has been found to be sufficient if the infeed cross-section or area is, for instance, about 10 centimeters greater than the outer cross-section of the employed pouring tube. Hence, a pouring tube having a diameter of, for instance, 60 millimeters therefore can already be exchanged when working with a billet cross-section of 160 millimeters, without having to lift the tundish or other intermediate vessel. When using the apparatus of the invention with pouring tubes arranged between a casting ladle and the tundish it is beneficially possible to dispense with the need to install expensive lifting mechanisms at the supporting devices for the casting ladles.

In order to prevent oxidation of the steel jet departing from the casting vessel, a space which is present following the introduction of the pouring tube, between the casting vessel and the infeed end of the pouring tube, can be protected by a protective gas curtain. With the infeed end of the pouring tube appropriately spaced from the bottom of the casting vessel the bottom pour discharge nozzle or opening is accessible to a limited extent at all times. Consequently, there is rendered possible visual observation of the casting or teeming jet and, when required, flame work with an oxygen lance can be carried out. It is possible to dispense with the use of such protective gas curtain if there is employed an additional feature of the invention, namely if there is provided a lifting mechanism which moves the pouring tube in the vertical casting position in the direction of the casting vessel. With this construction it is possible to mount a seal between the pouring tube and the floor or bottom of the casting vessel.

Moreover, the time needed to change a pouring tube can be shortened if part of the outfeed time of the worn pouring tube and part of the infeed time of the new or replacement pouring tube simultaneously transpire. To achieve this result it is recommended, according to the invention, to arrange in addition to the guide means for infeeding the pouring tube, a second approximately symmetrical guide means for withdrawing a pouring tube out of the casting position. With this apparatus there can be attained pouring tube-exchange times of 30 seconds and less.

With aluminum-killed steel it is possible for aluminum oxide to deposit within the bottom pour discharge nozzle and in the pouring tube. Such deposits can render more difficult or prevent the orderly detachment and removal of the used pouring tube at the seam location between the pouring tube and the discharge nozzle during exchange of the pouring tube. In order to ensure that the pouring tube can be detached, a further embodiment of the invention contemplates selecting the diameter of the infeed opening of the pouring tube to be greater than the outfeed side-diameter of the bottom pour discharge nozzle of the casting vessel. With this measure the throughflow cross-section of the pouring tube remains free of aluminum oxide deposits at the seam location.

An exemplary manifestation of the invention for realizing the defined path of movement for the pouring tube contemplates equipping such pouring tube with a pouring tube-holder and providing thereat, at each of two sides thereof, two guide pins or equivalent structure which cooperate with guides or guide elements connected at the casting vessel.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a fragmentary view illustrating two cooperating throughflow vessels, for instance one in the form of a tundish and the other in the form of a continuous casting mold, between which there is arranged a pouring tube, and schematically illustrating the paths of movement of a used pouring tube and a new pouring tube during the pouring tube-change operation;

FIG. 2 is a fragmentary view of a further embodiment of the invention utilizing a different path of movement of the pouring tube;

FIG. 3 is a fragmentary side view of a further exemplary embodiment of the invention; and FIG. 4 is a cross-sectional view of the arrangement of FIG. 3, taken substantially along the line IV—IV thereof.

DETAILED DESCRIPTION OF THE PREFERRED EMBODIMENTS

Describing now the drawings, in the exemplary embodiment of FIG. 1 there is illustrated a tundish 1 having a bottom pour discharge nozzle or opening 2 of a continuous casting installation for the casting of blooms for instance. Only enough of the structure of the continuous casting installation has been shown to enable those versed in the art to readily understand the underlying concepts of the invention. By means of a flow-regulating device, here shown in the form of a slide 3, it is possible to close the bottom pour opening 2. A pouring tube 6 extends into a conventional water-cooled continuous casting mold 5. Within the mold 5 there is located a cast strand consisting of a strand shell or skin 8 and a liquid core 9. Reference characters 10 and 11 designate the paths of movement provided for each pouring tube 6, and which can be realized with the aid of the guide means or guides, such as shown in FIGS. 3 and 4 and described more fully hereinafter in conjunction therewith. The horizontal path of movement 10 is associated with the infeed or inlet end 13 of the pouring tube 6 and the path of movement 11 is associated with the outlet or discharge end 14 of such pouring tube. The path of movement 11 extends in a substantially arcuate-shaped configuration into the hollow compartment or cavity 15 of the continuous casting mold 5, and such arc predominantly possesses a vertical component, as shown.

Reference character 6' shows in phantom lines the pouring tube 6 during the exchange operation. This pouring tube moves along the paths of travel 10' and 11', which likewise are determined by the guides or guide means, as illustrated for instance in FIGS. 3 and 4. The further phantom-line illustrated pouring tubes 6'' and 6''' portray the course of the movement of a new replacement pouring tube. From an approximately horizontal infeed or introduction position, where the outfeed or discharge end 14 of the pouring tube is directed towards the bottom pour outlet 2, the pouring tube 6'' is moved along the path of travel 11 until it has reached the position indicated by the pouring tube 6'''. As soon as the pouring tube 6' has moved past the point of intersection 17 of the paths of travel or movement 11, 11', the pouring tube 6''' can be brought into the vertical casting or pouring position. When desired, the pouring tube 6' also can be moved along the paths of travel 10, 11 and thereafter there can be introduced a new pouring tube 6'' at the same path of travel or movement. The time needed for exchanging a pouring tube, when using this mode of operation, is then somewhat longer.

Continuing, it will be seen that between the not particularly referenced outlet opening of the slide 3 and the pouring tube 6 there is formed a spacing 18. The casting or teeming jet can be protected against oxidation along this spacing, which can be varied in size, by means of a suitable gas curtain or the like. Typically, there can be used a noble gas or a reducing gas, but instead of such there can also be employed gaseous or liquid nitrogen.

Now in the modified arrangement shown in FIG. 2 a path of movement or travel 21 for the outfeed or outlet end 14 of the pouring tube extends exactly vertically throughout its entire length and a path of travel or movement 20 for the infeed or inlet end 13 of the pouring tube extends exactly horizontally. Reference character 22 designates a throughflow vessel, which as previously indicated may be, for instance, constituted by a continuous casting mold or a tundish.

Turning attention now to the variant embodiment shown in FIGS. 3 and 4, reference character 31 designates a casting ladle having a bottom pour discharge nozzle or outlet 32. A pouring tube 36, arranged substantially concentrically with respect to the bottom outlet 32, immerses into the inner-infeed cross-section or receiving opening 35 of the cover 33 of a tundish 34 used in a continuous casting installation for slabs, by way of example. At the floor or bottom 31' of the casting ladle 31 there are attached the flanges 37 to both sides of the pouring tube 36. The flanges 37 are provided with the guides 38 and 39, here shown for instance in the form of the guide tracks 38'' and 39'' (FIG. 3) or equivalent structure provided at the flanges 37. Now at two opposite sides of a pouring tube-holder 40 there are arranged at a support or carrier flange 41 two respective guide pins 42, 43. The one guide 38 cooperates with the upper guide pins 42 and thus determines the approximately horizontal path of movement of the inlet or infeed end 13 of the pouring tube 36 and the other guide 39 cooperates with the lower guide pins 43 and thus defines the approximately vertical path of travel or movement for the outfeed or outlet end 14 of the pouring tube 36. In FIG. 4 there has been shown a pouring tube 36' in phantom lines, located along the infeed path, and governed by the position of the pouring tube-holder 40 with respect to the center of gravity of the pouring tube the guide pins 42' bear against the guide 38 and the guide pins 43' against the guide 39. In addition to the guides 38 and 39 at the side for introducing a pouring tube 36 into casting position, there may be further provided a second approximately symmetrical guide means or guides 38' and 39' — which may be constituted by guide tracks, similar to the previously discussed guide tracks 38'' and 39'' — for the removal of the pouring tube 36 out of the casting position.

The pouring tube-holder 40 together with the guide pins 42, 43 or equivalent structure, can be arranged lower, for instance approximately at the center of gravity of the pouring tube 36 or at the outlet side of the center of gravity. The construction of the guides 38, 39 is to be accommodated to the position of the pouring tube-holder 40 in relation to the center of gravity. It is not necessary to secure the guides 38, 39 which are arranged above the throughflow vessel, here shown as the tundish 34, at the casting vessel, in this case the ladle 31. It is equally possible to arrange such guides 38, 39 also, for instance, at the machine frame, at a ladle carriage or tundish carriage.

In order to be able to sealingly contact the pouring tube 36 against the bottom pour outlet 32, the pouring tube-holder 40 is provided with a lifting device or mechanism for urging the pouring tube 36 in the direction of the casting ladle 31. In the embodiment under discussion, such lifting device or mechanism comprises a ring 46 arranged concentrically with respect to the pouring tube-holder 40 and movable along a helical line 45. When necessary, there can be inserted a conventional seal between the pouring tube 36 and the bottom pour outlet 32.

Further, by means of a stopper 50 or any other suitable shut-off device, it is possible to interrupt the inflow of steel prior to the start of the pouring tube-exchange operation and after completion thereof to again open such stopper.

The diameter 51 of the inlet or infeed opening of the pouring tube 36 is larger than the outfeed side-diameter of the bottom pour outlet 32. The bottom pour outlet or discharge nozzle 32, especially when using slides, additionally can be equipped with a short, funnel-shaped attachment or extension piece for forming a closed casting or teeming jet. When using such attachment or extension piece the diameter of the bore at the inlet side is greater than the diameter of the slide bore at the outlet side and the diameter of the bore at the outlet side of the attachment or extension piece is smaller than the inlet opening of the pouring tube 36. In order to be able to retain a slim form for the part of the pouring tube which is immersed in the throughflow vessel, it is advantageous to configure the pouring tube 36 at the inlet side so as to possess a substantially funnel-shaped construction.

The apparatus of the invention can be advantageously employed both in conjunction with billet casting machines and bloom casting machines as well as also slab casting machines of any desired cross-section.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for exchanging pouring tubes at a casting vessel having a closeable bottom pour outlet of a continuous casting installation, each pouring tube having an infeed end and outfeed end for the molten metal to be teemed, wherein each pouring tube when assuming its casting position extends substantially vertically with its outfeed end immersed in a throughflow vessel, said apparatus comprising:

guide means providing different paths of travel for the infeed end and outfeed end of the pouring tubes moved from an approximately horizontal pouring tube-infeed position into an approximately vertical casting position;

said different paths of travel comprising a substantially horizontal path of travel for the infeed end of each pouring tube and a substantially vertical path of travel in a vertical plane for the outfeed end of each pouring tube, and wherein at least part of the vertical path of travel in said vertical plane extends within the throughflow vessel.

2. The apparatus as defined in claim 1, further including:

lifting means for moving the pouring tube which is in vertical casting position in a direction towards the casting vessel.

3. The apparatus as defined in claim 1, wherein:

the pouring tube in casting position has an inlet opening possessing a diameter greater than the diameter at the outlet side of the bottom pour outlet of the casting vessel.

4. The apparatus as defined in claim 1, wherein: said throughflow vessel is a tundish.

5. The apparatus as defined in claim 4, wherein: said casting vessel is a ladle.

6. The apparatus as defined in claim 1, wherein: said throughflow vessel is a continuous casting mold.

7. The apparatus as defined in claim 6, wherein: said casting vessel is a tundish.

8. An apparatus for exchanging pouring tubes at a casting vessel having a closeable bottom pour outlet of a continuous casting installation, each pouring tube having an infeed end and outfeed end for the molten metal to be teemed, wherein each pouring tube when assuming its casting position extends substantially vertically with its outfeed end immersed in a throughflow vessel, said apparatus comprising:

guide means providing different paths of travel for the infeed end and outfeed end of the pouring tubes moved from an approximately horizontal pouring tube-infeed position into an approximately vertical casting position;

said different paths of travel comprising a substantially horizontal path of travel for the infeed end of each pouring tube and a substantially vertical path of travel for the outfeed end of each pouring tube, and wherein at least part of the vertical path of travel extends within the throughflow vessel; and additional guide means for withdrawing each pouring tube out of the casting position.

9. The apparatus as defined in claim 8, wherein:

said additional guide means is substantially symmetrically arranged with respect to said guide means for infeeding the pouring tubes to the casting position.

10. An apparatus for exchanging pouring tubes at a casting vessel having a closeable bottom pour outlet of a continuous casting installation, each pouring tube having an infeed end and outfeed end for the molten metal to be teemed, wherein each pouring tube when assuming its casting position extends substantially vertically with its outfeed end immersed in a throughflow vessel, said apparatus comprising:

guide means providing different paths of travel for the infeed end and outfeed end of the pouring tubes moved from an approximately horizontal pouring tube-infeed position into an approximately vertical casting position;

said different paths of travel comprising a substantially horizontal path of travel for the infeed end of each pouring tube and a substantially vertical path of travel for the outfeed end of each pouring tube, and wherein at least part of the vertical path of travel extends within the throughflow vessel; and pouring tube-holder means for supporting a pouring tube;

said pouring tube-holding means being provided at two opposite sides thereof with a respective pair of guide pins which coact with said guide means.

11. The apparatus as defined in claim 10, wherein:

said guide means are connected with said casting vessel.

* * * * *